US008481926B2

(12) United States Patent
Loboda

(10) Patent No.: US 8,481,926 B2
(45) Date of Patent: Jul. 9, 2013

(54) METHOD, SYSTEM AND APPARATUS FOR FILTERING IONS IN A MASS SPECTROMETER

(75) Inventor: Alexandre Loboda, Thornhill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 293 days.

(21) Appl. No.: 12/873,408

(22) Filed: Sep. 1, 2010

(65) Prior Publication Data

US 2011/0057095 A1 Mar. 10, 2011

Related U.S. Application Data

(60) Provisional application No. 61/239,954, filed on Sep. 4, 2009.

(51) Int. Cl.
*H01J 49/40* (2006.01)

(52) U.S. Cl.
USPC ..... 250/287; 250/281; 250/282

(58) Field of Classification Search
USPC ..... 250/281, 282, 283, 287, 290, 291, 250/292, 293, 294, 295, 296, 297, 298, 299
See application file for complete search history.

(56) References Cited

U.S. PATENT DOCUMENTS

| | | | | |
|---|---|---|---|---|
| 4,736,101 | A * | 4/1988 | Syka et al. | 250/292 |
| 6,992,285 | B1 | 1/2006 | Cousins et al. | |
| 7,095,014 | B2 | 8/2006 | Hoyes | |
| 7,449,686 | B2 | 11/2008 | Wang et al. | |
| 7,456,388 | B2 | 11/2008 | Loboda et al. | |
| 7,714,279 | B2 * | 5/2010 | Franzen | 250/287 |
| 2002/0063211 | A1 | 5/2002 | Hager | |
| 2004/0041091 | A1 * | 3/2004 | Bateman et al. | 250/282 |
| 2006/0016979 | A1 * | 1/2006 | Yang et al. | 250/288 |
| 2009/0014645 | A1 | 1/2009 | Chernushevich et al. | |

OTHER PUBLICATIONS

PCT Application No. PCT/CA2010/001357 International Search Report mailed Dec. 15, 2010.

PCT Application No. PCT/CA2010/001357 Written Opinion of the International Searching Authority mailed Dec. 15, 2010.

Quadrupole Mass Spectrometry and its Applications by Peter H. Dawson Figure 2.10 p. 20. Definitions of a and q parameters—eqns 2.19, 2.20 p. 13, 2010.

* cited by examiner

*Primary Examiner* — Nicole Ippolito

(57) ABSTRACT

A method and mass spectrometer for filtering ions are provided. The mass spectrometer generally comprises an ion guide, a quadrupole mass filter, a collision cell and a time of flight (ToF) detector, and is enabled to transmit an ion beam through to the ToF detector. The mass spectrometer is operated in MS mode, such that ions in the ion beam remain substantially unfragmented, the quadrupole mass filter operating at a pressure substantially lower than in either of the ion guide and the collision cell. The quadrupole mass filter is operated in a bandpass mode such that ions outside of a range of interest are filtered from the ion beam, leaving ions inside the range of interest in the ion beam. The ions inside the range of interest are analyzed at the ToF detector.

19 Claims, 6 Drawing Sheets

METHOD, SYSTEM AND APPARATUS FOR FILTERING IONS IN A MASS SPECTROMETER

FIELD

The specification relates generally to mass spectrometers, and specifically to a method and apparatus for filtering ions in a mass spectrometer.

BACKGROUND

When a mass spectrometer operates in MS mode, the entire ion population of an ion beam is sampled, and is generally not fragmented. However, ion populations often contain species scattered across a wide mass range. When a mass range of interest is much narrower than the mass range of the ions present in the ion beam, certain problems can arise. Specifically, when a continuous ion flow is recorded in an orthogonal time of flight (ToF) mass spectrometer one problem that can be observed is a "wrap around" of arrival events. The "wrap around" occurs when ToF repetition rate is set relatively high, sufficient to record the mass range of interest, yet the high m/z species present in the beam are flying slower and therefore can arrive in association with following extractions, thereby contaminating the spectrum of the following extractions. In other words, since high m/z species are flying slower they can show up in the consequent ToF extractions instead of the original ToF extraction window, hence appearing as low mass species that are not actually present. Another problem, also related to the presence of ions outside of the mass range of interest, is that they "eat up" detection capacity of the ToF detector: when there is a strong presence of ion species that fall outside of the mass range of interest, and since those species still arrive at the ToF detector, then detector saturation can occur. In addition, the lifetime of the detector can be shortened.

SUMMARY

A first aspect of the specification provides a method for filtering ions in a mass spectrometer, the mass spectrometer comprising an ion guide, a quadrupole mass filter, a collision cell and a time of flight (ToF) detector, the mass spectrometer enabled to transmit an ion beam through to the ToF detector. The method comprises operating the mass spectrometer in MS mode, such that ions in the ion beam remain substantially unfragmented, the quadrupole mass filter operating at a pressure substantially lower than in either of the ion guide and the collision cell. The method further comprises operating the quadrupole mass filter in a bandpass mode such that ions outside of a range of interest are filtered from the ion beam, leaving ions inside the range of interest in the ion beam. The method further comprises analyzing the ions inside the range of interest at the ToF detector.

A low mass boundary and a high mass boundary of the range of interest can be defined by a combination of an RF voltage and a DC voltage applied to the quadrupole mass filter. The RF voltage and DC voltage applied to the quadrupole mass filter can be determined based on a stability diagram for the quadrupole mass filter. Operating the quadrupole mass filter in a bandpass mode such that ions outside of the range of interest are filtered from the ion beam can comprise adjusting the RF voltage and the DC voltage such that a slope of an operating line on the stability diagram for the quadrupole mass filter changes, thereby controlling the low mass boundary and the high mass boundary. The stability diagram can be derived from Mathieu's equation. The RF voltage and the DC voltage can be determined by interpolating data for different transmission windows acquired at the mass spectrometer.

Analyzing the ions inside the range of interest at the ToF detector can comprise overpulsing ToF extraction to increase a duty cycle of the mass spectrometer. The method can further comprise coordinating a width of the range of interest with the overpulsing.

The method can further comprise fragmenting the ions inside the range of interest in the ion beam, via the collision cell, prior to analyzing ions from the collision cell at the ToF detector. Fragmenting the ions inside the range of interest in the ion beam, via the collision cell can occur by at least one of controlling kinetic energy of the ions inside range of interest to a value sufficient to cause the fragmentation, and controlling pressure of the collision cell to a value sufficient to cause the fragmentation. The method can further comprise: alternating between fragmenting the ions inside the range of interest in the collision cell and allowing the ions in the range of interest to pass through the collision cell unfragmented; and collecting mass spectra of fragmented and unfragmented ions at the ToF detector for analysis. The method can further comprise operating the collision cell in a bandpass mode by applying a combination of RF and DC voltages in the collision cell such that at least a portion of the ions outside of a fragmented range of interest are filtered from the ion beam, leaving ions inside the fragmented range of interest in the ion beam.

A pressure in the ion guide and the collision cell can be in a mTorr range and the pressure in the quadrupole mass filter can be in a $10^{-5}$ Torr range.

A second aspect of the specification provides a mass spectrometer for filtering ions, comprising an ion guide, a quadrupole mass filter, a collision cell and a time of flight (ToF) detector. The mass spectrometer is enabled to transmit an ion beam from the ion guide through to the ToF detector. The mass spectrometer is further enabled to operate in MS mode, such that ions in the ion beam remain substantially unfragmented, the quadrupole mass filter operating at a pressure substantially lower than in either of the ion guide and the collision cell. The mass spectrometer is further enable to operate the quadrupole mass filter in a bandpass mode such that ions outside of a range of interest are filtered from the ion beam, leaving ions inside the range of interest in the ion beam. The mass spectrometer is further enabled to analyze the ions inside the range of interest at the ToF detector.

A low mass boundary and a high mass boundary of the range of interest can be defined by a combination of an RF voltage and a DC voltage applied to the quadrupole mass filter. The RF voltage and DC voltage applied to the quadrupole mass filter can be determined based on a stability diagram for the quadrupole mass filter. To operate the quadrupole mass filter in a bandpass mode such that ions outside of the range of interest are filtered from the ion beam, the mass spectrometer is further enabled to adjust the RF voltage and the DC voltage such that a slope of an operating line on the stability diagram for the quadrupole mass filter changes, thereby controlling the low mass boundary and the high mass boundary. The RF voltage and the DC voltage can be determined by interpolating data for different transmission windows acquired at the mass spectrometer.

Analyzing the ions inside the range of interest at the ToF detector can comprise overpulsing ToF extraction to increase a duty cycle of the mass spectrometer. The mass spectrometer can be further enabled to coordinate a width of the range of interest with the overpulsing.

The mass spectrometer can be further enabled to fragment the ions inside the range of interest in the ion beam, via the collision cell, prior to analyzing ions from the collision cell at the ToF detector. Fragmentation of the ions inside the range of interest in the ion beam, via the collision cell can occur by at least one of controlling kinetic energy of the ions inside range of interest to a value sufficient to cause the fragmentation, and controlling pressure of the collision cell to a value sufficient to cause the fragmentation. The mass spectrometer can be further enabled to: alternate between fragmenting the ions inside the range of interest in the collision cell and allowing the ions in the range of interest to pass through the collision cell unfragmented; and collecting mass spectra of fragmented and unfragmented ions at the ToF detector for analysis. The mass spectrometer can be further enabled to operate the collision cell in a bandpass mode by applying a combination of RF and DC voltages in collision cell such that at least a portion of the ions outside of a fragmented range of interest are filtered from the ion beam, leaving ions inside the fragmented range of interest in the ion beam.

A pressure in the ion guide and the collision cell can be in a mTorr range and the pressure in the quadrupole mass filter can be in a $10^{-5}$ Torr range.

BRIEF DESCRIPTIONS OF THE DRAWINGS

Embodiments are described with reference to the following figures, in which.

Figure 1:
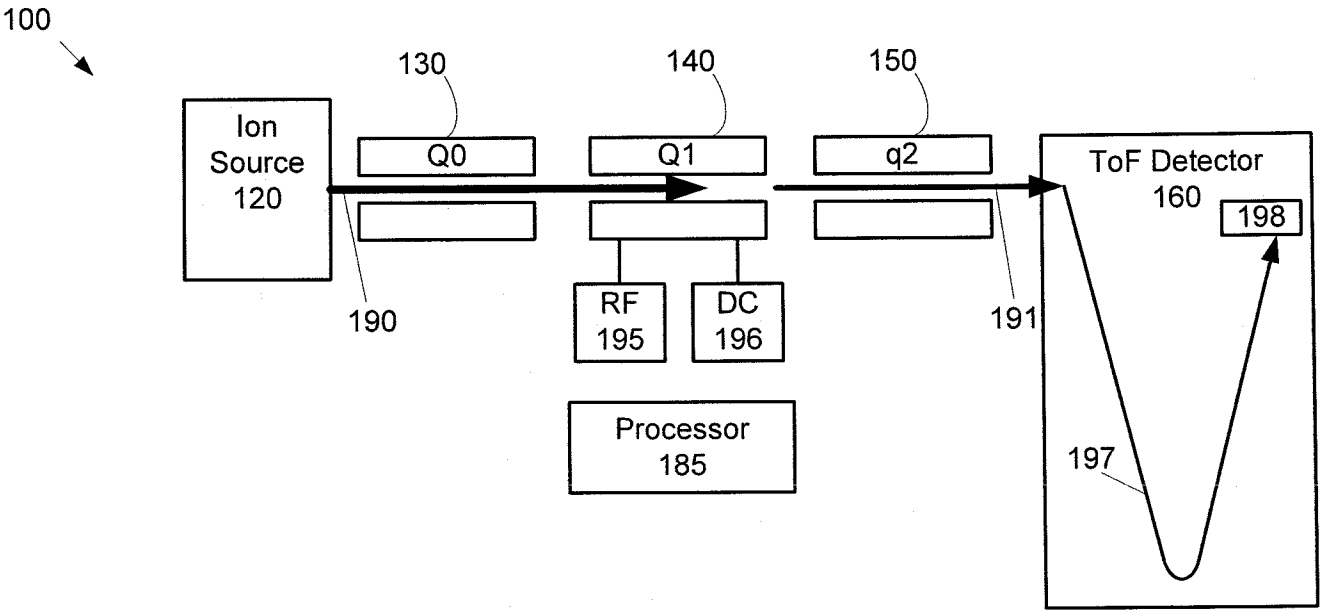
FIG. 1 depicts a block diagram of a mass spectrometer enabled to filter ions in a range of interest via a quadrupole mass filter, according to non-limiting embodiments.
Figure 5:
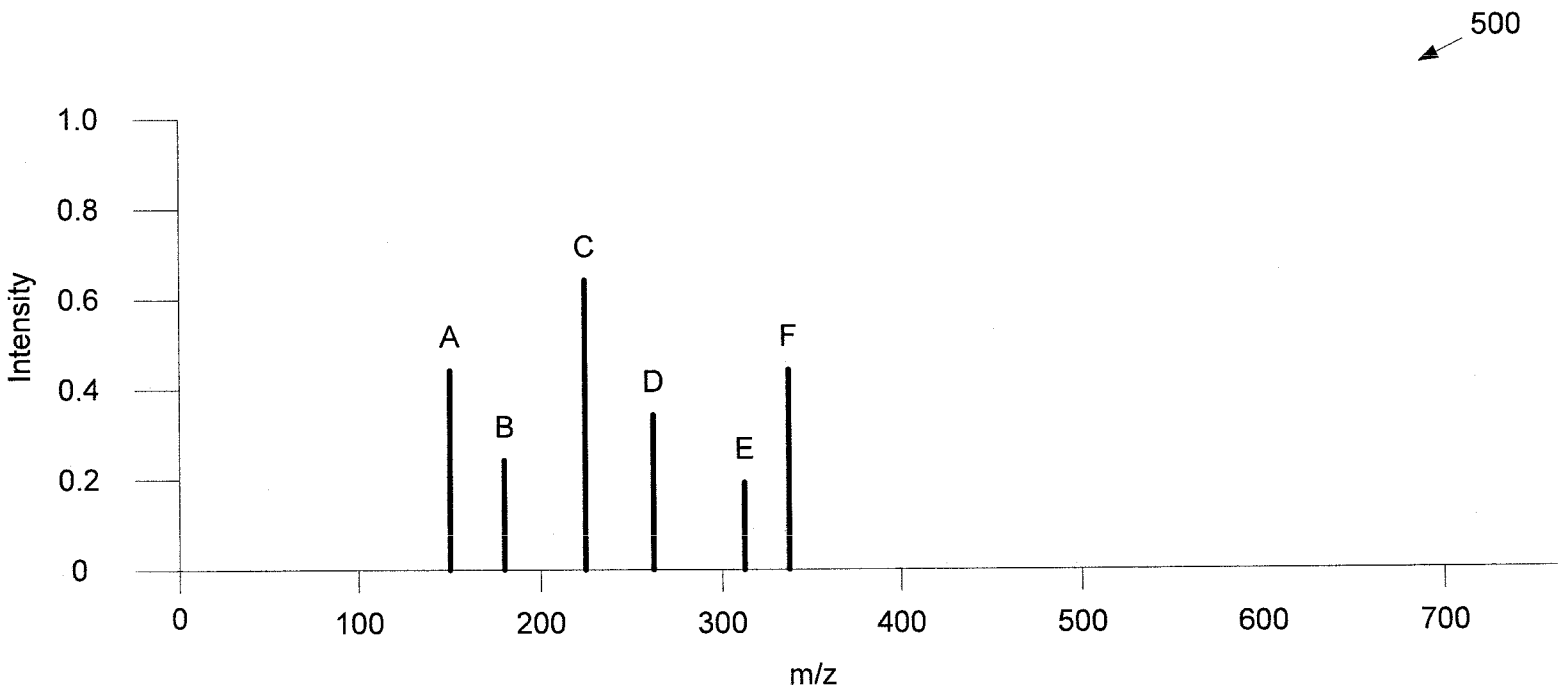
Figure 6:
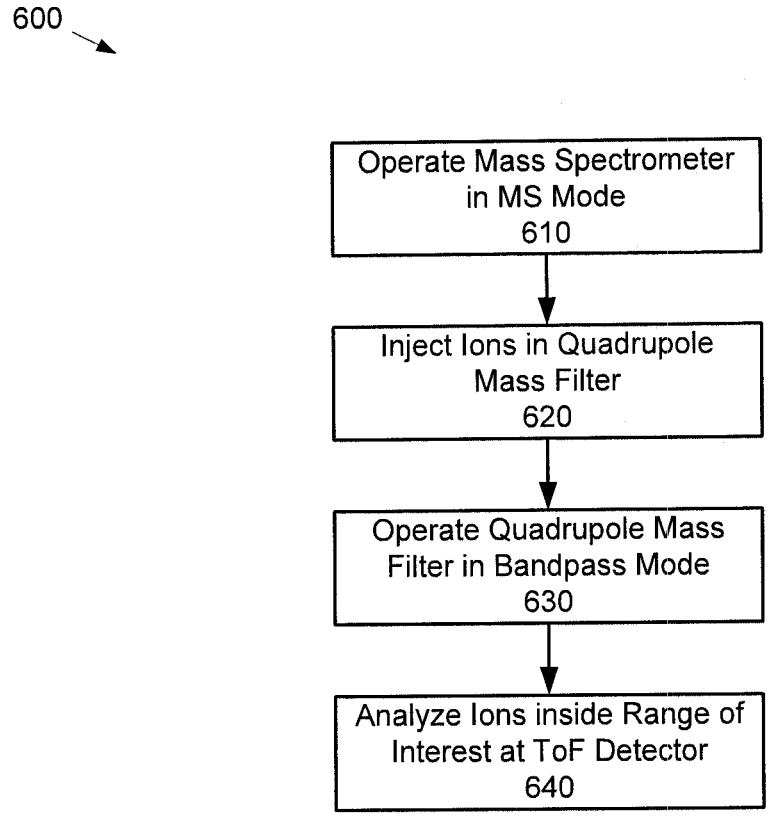

FIG. 5 depicts a schematic diagram of a representative mass spectrum collected from a ToF detector in the mass spectrometer of FIG. 1 when ions in a range of interest are filtered via a quadrupole mass filter, according to non-limiting embodiments; and FIG. 6 depicts a block diagram of a method 600 for filtering ions in a range of interest in a mass spectrometer, according to non-limiting embodiments

DETAILED DESCRIPTION OF THE EMBODIMENTS

FIG. 1 depicts a mass spectrometer, the mass spectrometer comprising an ion guide 130, a quadrupole mass filter 140, a collision cell 150 (e.g. a fragmentation module) and a time of flight (ToF) detector 160, mass spectrometer 100 enabled to transmit an ion beam from ion source 120 through to ToF detector 160. In some embodiments, mass spectrometer 100 can further comprise a processor 185 for controlling operation of mass spectrometer 100, including but not limited to controlling ion source 120 to ionise the ionisable materials, and controlling transfer of ions between modules of mass spectrometer 100. In particular, processor 185 controls quadrupole mass filter 140, as described below and is further enabled to process mass spectra acquired via ToF detector 160. In some embodiments, mass spectrometer 100 further comprises any suitable memory device for storing product mass spectra.

In operation, ionisable materials are introduced into ion source 120. Ion source 120 generally ionises the ionisable materials to produce ions 190, in the form of an ion beam, which are transferred to ion guide 130 (also identified as Q0, indicative that ion guide 130 take no part in the mass analysis). Pressure in ion guide 130 is controlled such that a sufficient number of collisions occur between ions 190 and a carrier gas to enable collisional focusing of the ion beam while ions 190 move along the length of ion guide 130. In some embodiments, pressure in ion guide 130 is controlled to be approximately 5 mTorr. In other embodiments, pressure in ion guide 130 can be controlled to any suitable value, for example in range between 1 and 100 mTorr.

Ions 190 are transferred from ion guide 130 to quadrupole mass filter 140 (also identified as Q1) via suitable electric fields and/or pressure differentials, quadrupole mass filter 140 enabled for operation in a bandpass mode such that ions outside of a range of interest are filtered from the ion beam, leaving ions 191 inside the range of interest in the ion beam, in a manner described below.

Ions 191 ejected from quadrupole mass filter 140 can then be transferred to collision cell 150 (also identified as q2) via any suitable electric field. In some embodiments, mass spectrometer 100 is operated in MS mode, such that ions 191 passing through collision cell 150 remain substantially unfragmented. Ions 191 are subsequently transferred to ToF detector 160 for mass analysis, via any suitable electric field and/or pressure differential, resulting in production of ion spectra.

In general, it is understood that quadrupole mass filter 140 is operating at a pressure substantially lower than a pressure in either of ion guide 130 or collision cell 150, for efficient filtering of ions 190 and to ensure that no collisions and/or fragmentation of ions 190 occur in quadrupole mass filter 140. For example, in some embodiments, pressure in quadrupole mass filter 140 can be controlled to be on the order of $10^{-5}$ Torr (i.e. $10^{-2}$ mTorr). It is understood that only a small proportion of ions 190 experience collisions in quadrupole mass filter 140 below approximately $10^{-4}$ Torr. While in some embodiments quadrupole mass filter 140 can be enabled to operate at much lower pressure such as $10^{-7}$ Torr, this is generally achieved with substantial added cost without necessarily providing additional benefits. As described above, pressure in ion guide 130 can be controlled to a pressure of approximately 5 mTorr such that ion guide 130 acts in part as a pressure differential between ion source 120 (which is substantially at atmospheric pressure) and quadrupole mass filter 140. Furthermore, in some embodiments, collision cell 150 is controlled to a pressure that will cause fragmentation and collisional focusing of ions 191 before they pass into ToF detector 160. In some embodiments, collision cell 150 is controlled to a pressure of approximately 5 mTorr.

However when mass spectrometer 100 is operated in MS mode, kinetic energy with which ions 191 enter collision cell 150 is controlled to be low enough so as to not cause substantial fragmentation of ions 191, for example by applying a suitable electric field accelerating ions between quadrupole mass filter 140 and collision cell 150. However, as described above, pressure in quadrupole mass filter 140 is substantially lower than pressure in collision cell 150 and pressure in ion guide 130; for example, in present exemplary embodiments, pressure in quadrupole mass filter 140 is approximately 2 orders of magnitude lower than pressure in collision cell 150 and pressure in ion guide 130. In other embodiments, pressure in quadrupole mass filter 140 is at least 2 orders of magnitude lower than pressure in collision cell 150 and pressure in ion guide 130.

The transition between no fragmentation (MS mode) and fragmentation (MSMS mode) of ions 191 in mass spectrometer 100 occurs as the voltage difference between DC voltages of ion guide 130 and collision cell 150 is increased, thereby imparting higher kinetic energy to ions 191 entering collision cell 150. The energy at which fragmentation of ions 191 starts to occur is generally understood to be dependent on the properties of the compound(s) under investigation, i.e. the ionisable materials introduced into ion source 120.

It is further understood that, in some embodiments, in non-fragmenting (MS) mode, collision cell 150 can be operated at a low pressure similar to the pressure in quadrupole mass filter 140 so that fragmentation does not occur. However, there are certain disadvantages of operating collision cell 150 at a low pressure in MS mode. First of all, analysis of ions 191 can comprise rapid switching between MS and MSMS modes where ions 191 are non-fragmented in the MS mode and fragmented in MSMS mode. If the pressure in collision cell 150 is to be controlled to change between these modes (rather than the kinetic energy of ions 191), control of the pressure in collision cell 150 generally must be done rapidly, which requires additional equipment (pumps etc.) and hence additional expense to provisioning and building mass spectrometer 100, as well as complexity to the analytical procedure. Indeed, without such additional equipment, it is understood that the time to pump down to the low pressures required to prevent fragmentation when ions 191 have a higher kinetic energy (e.g. approximately $10^{-5}$ Torr) can be long and doing so would substantially reduce the throughput of mass spectrometer 100. Alternatively, a CAD gas management system can be incorporated into mass spectrometer 100 to speed up the pressure change in collision cell 150 but this can add substantial complexity and cost to mass spectrometer 100.

Another reason to operate collision cell 150 at high pressure in the non-fragmenting MS mode is to reduce mechanical alignment problems in the region between ion guide 130 and collision cell 150, since the presence of gas in collision cell 150 leads to collisional focusing of the ion beam. If the pressure in collision cell 150 is varied between fragmenting MSMS mode and non-fragmenting MS modes, then tuning of ion beam in TOF detector 150 can be different for each of these modes, with different calibration parameters. But, if the pressure in collision cell 150 is kept sufficiently high (i.e. the same or similar) in both MS and MSMS modes then ions exiting collision cell 150 will have the same properties in both modes due to collisional focusing. Hence, in exemplary embodiments, pressure in collision cell 150 is maintained at the same pressure, on the order of 5 mTorr, while the pressure in quadrupole mass filter 140 is substantially lower, on the order of $10^{-5}$ Torr, to ensure that for most ions transiting this region no collisions occur within mass filter 140. If the pressure in quadrupole mass filter 140 is too high, collisions will occur between ions and residual molecules which in turn leads to losses of ions 190.

Furthermore, while not depicted, mass spectrometer 100 can comprise any suitable number of vacuum pumps to provide a suitable vacuum in ion source 120, ion guide 130, quadrupole mass filter 140, collision cell 150 and/or ToF detector 160. It is understood that in some embodiments a vacuum differential can be created between certain elements of mass spectrometer 100: for example a vacuum differential is generally applied between ion source 120 and ion guide 130, such that ion source 120 is at atmospheric pressure and ion guide 130 is under vacuum. While also not depicted, mass spectrometer 100 can further comprise any suitable number of connectors, power sources, RF (radio-frequency) power sources, DC (direct current) power sources, gas sources (e.g. for ion source 120 and/or collision cell 150), and any other suitable components for enabling operation of mass spectrometer 100.

Ion source 120 comprises any suitable ion source for ionising ionisable materials. Ion source 120 can include, but is not limited to, an electrospray ion source, an ion spray ion source, a corona discharge device, and the like. In these embodiments, ion source 120 can be connected to a mass separation system (not depicted), such as a liquid chromatography system, enabled to dispense (e.g. elute) ionisable to ion source 120 in any suitable manner.

In some non-limiting embodiments, ion source 120 can comprise a matrix-assisted laser desorption/ionisation (MALDI) ion source, and samples of ionisable materials are first dispensed onto a MALDI plate, which can generally comprise a translation stage. Correspondingly, ion source 120 is enabled to receive the ionisable materials via the MALDI plate, which can be inserted into the MALDI ion source, and ionise the samples of ionisable materials in any suitable order. In these embodiments, any suitable number of MALDI plates with any suitable number of samples dispensed there upon can be prepared prior to inserting them into the MALDI ion source. It is generally understood, however, that ion source 120 is generally non-limiting and any suitable ion source is within the scope of present embodiments.

Ions 190 produced at ion source 120 are transferred to ion guide 130, for example via a vacuum differential and/or a suitable electric field(s) and/or a carrier gas. Ion guide 130 can generally comprise any suitable multipole or RF ion guide including, but not limited to, a quadrupole rod set. Ion guide 130 is generally enabled to cool and focus ions 190, and can further serve as an interface between ion source 120, at atmospheric pressure, and subsequent lower pressure vacuum modules of mass spectrometer 100.

Ions 191 are then transferred to quadrupole mass filter 140, for example via any suitable vacuum differential and/or a suitable electric field(s). As described above, quadrupole mass filter 140 is maintained at a substantially lower pressure than either of ion guide 130 or collision cell 150 to prevent fragmentation and/or scattering loss of ions 190, to ensure throughput, and to ensure that a relatively narrow filtering capability is possible (for example as low as 1 amu, or alternatively 1 m/z: it is understood that "amu" and "m/z" unit can generally be used interchangeably). In general, quadrupole mass filter 140 is enabled to operate in a bandpass mode such that ions from outside of a range of interest are filtered from ions 190 in the ion beam, leaving ions 191 inside the range of interest in the ion beam. In general, the filtering capability of the quadrupole mass filter 140 is controlled via at least an RF power source 195 and a DC power source 196, which can be controlled by processor 185. Furthermore, the connections between RF power source 195, DC power source 196 and quadrupole mass filter 140 depicted in FIG. 1 are understood to be schematic only, and that actual connections to each of the poles in the quadruple mass filter 140, as well as between RF power source 195 and DC power source 196 are suitable to control quadrupole mass filter 140 for filtering ions 191 inside the range of interest.

Ions 191 are then transferred to collision cell 150. If mass spectrometer 100 is operating in an MSMS mode, ions 191 can be fragmented such that product ions are produced. However, in present embodiments, it is understood that mass spectrometer 100 is operated in an MS mode: collision cell 150 is operated in a low energy mode (and/or alternatively at low pressure) such that ions 191 remain substantially unfragmented. Hence, ions 191 are transferred to ToF detector 160 for analysis and production of ion spectra (i.e. mass spectra). ToF detector 160 can comprise any suitable time of flight mass detector module including, but not limited to, an orthogonal time of flight (TOF) detector, a reflectron ToF detector, a tandem ToF detector and the like.

Figure 2:
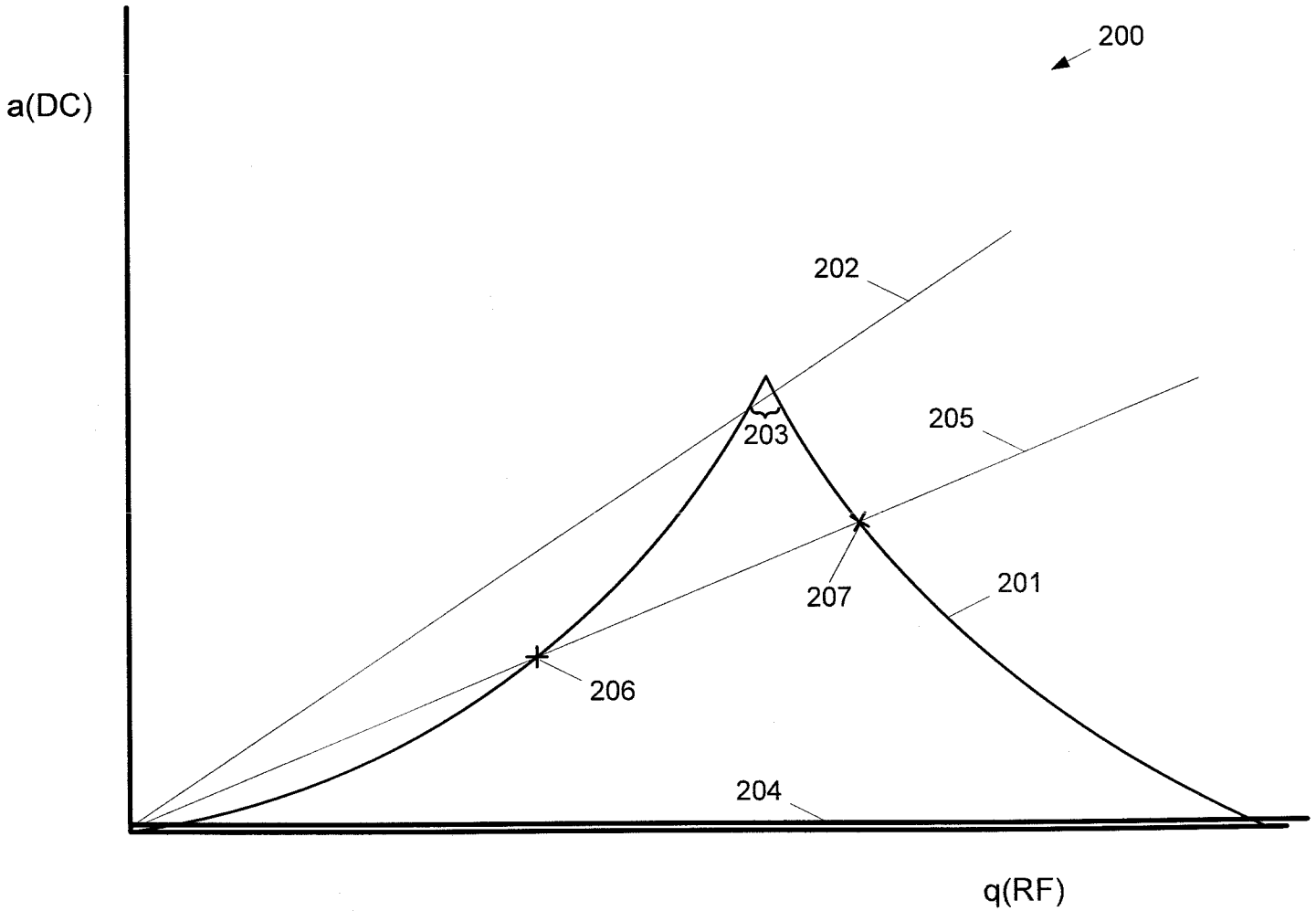
FIG. 2 depicts a schematic of a stability diagram of a quadrupole mass filter in a mass spectrometer, according to non-limiting embodiments.

Returning now to quadrupole mass filter 140, it is understood that a low mass boundary and a high mass boundary of the range of interest are defined by a combination of an RF voltage and a DC voltage applied to quadrupole mass filter 140. Furthermore, it is understood that the filtering of quadrupole mass filter 140 generally operates according to a stability diagram. For example, a schematic of a stability diagram 200 is depicted in FIG. 2, according to non-limiting embodiments. In general, the RF and DC voltages applied to quadrupole mass filter 140 in order to control the low mass boundary and the the high mass boundary can be determined based on a stability diagram such as stability diagram 200.

In general, stability diagram 200 can be derived from Mathieu's equation as known to a person of skill in the art. Stability diagram 200 is a function of a variable a, which depends on a DC voltage applied to quadrupole mass filter 140 via DC power source 196, and a variable q, which depends on an RF voltage applied to quadrupole mass filter 140 via RF power source 195. Furthermore, both a and q variables are inversely proportional to the mass to charge ratio (m/z) of a given ion. Stability diagram 200 is derived based on an assumption of a "good vacuum" i.e. no collisions between ions and buffer gas molecules. It is understood that collisions with buffer gas molecules can have a detrimental effect on ion transmission in a quadrupole mass filter due to fragmentation and scattering losses. Curve 201 is representative of the stability of quadrupole mass filter 140 such that combinations of a and q located under the curve 201 represent stable operating modes of quadrupole mass filter 140, where, for a given ion, its trajectory is stable and confined within the boundaries of the quadrupole mass filter; combinations of a and q above curve 201 represent conditions where ion motion is unstable and ions eventually strike electrodes of quadrupole mass filter 140 while advancing along a longitudinal axis of quadrupole mass filter 140. Furthermore, line 202 represents an operating line, as known to a person of skill in the art, for quadrupole mass filter 140, since for a given set of RF and DC voltages, ions with different m/z values are all distributed along this line. The intersection 203 between line 202 and curve 201 is representative of the mass range of interest of ions 191 filtered by quadrupole mass filter 140. In essence, line 202 represents an entire range of masses of ions that can enter quadrupole mass filter 140, and only those ions of masses that are within the intersection points on the operating line 202 pass through the quadrupole mass filter (i.e. in intersection 203). Furthermore, by adjusting the RF and DC voltages proportionally, the slope of the operating line 202 remains the same while the boundaries of masses of the ions filtered by quadrupole mass filter 140 can be controlled, for example by moving the mass of ions up and down line 202 such that different masses are within the intersection 203. In the prior art, intersection 203 is kept deliberately narrow (for example, as low as 1 amu), in order to ensure good resolution of mass spectrometer 100, especially when mass spectrometer 100 is operating in MSMS mode. Furthermore, the resolution of mass spectrometer 100 is dependent on the pressure in quadrupole mass filter 140, and is hence an additional reason for keeping quadrupole mass filter 140 at low pressure.

However, the slope and intersection of line 202 can be controlled by varying the RF voltage (e.g. amplitude, frequency, absolute average value etc.), and the DC voltage (e.g the average value) applied to quadrupole mass filter 140 independently. For example, line 204 represents an operating line for quadrupole mass filter 140, with the DC voltage being at zero volts, such that quadrupole mass filter 140 transmits all ions 190 above the low mass cut-off range (i.e. the range of interest is the full mass range of quadrupole mass filter 140 above the cut-off mass determined by the RF voltage and frequency as well as dimensions of quadrupole mass filter 190). Note that while line 204 is depicted as being offset from the x-axis of stability diagram 200 for clarity, it is understood that line 204 runs along the x-axis.

Hence, by adjusting the RF and DC voltages independently, an operating line such as line 205 can be produced, with a slope of line 205 on stability diagram 200 changing according to the RF and DC voltage, thereby controlling the high mass boundary, represented by the intersection 206 between line 205 and curve 201, and a low mass boundary, represented by the intersection 207 between line 205 and curve 201. Furthermore, the reproducibility of the low mass boundary and high mass boundary of the region of interest is dependent on the pressure in quadrupole mass filter 140. Low mass boundary and high mass boundary are expected to be better defined and stable under high vacuum conditions due to elimination of interactions between ions 190 and the carrier gas in quadrupole mass filter 140.

In some embodiments, diagrams such as stability diagram 200 can be used to determine the RF and DC voltages for obtaining a range of interest for ions 191, such that ions 191 in the range of interest are transmitted through quadrupole mass filter 140 while the ions outside of the range of interest are generally discarded. In other embodiments, while it is understood that quadrupole mass filter 140 operates according to a stability diagram, such as stability diagram 200, the RF and DC voltages for controlling the range of interest are determined by interpolating data obtained for different transmission windows (i.e. different ranges of interest) acquired at mass spectrometer 100. For example, known samples can be introduced into ion source 120, and RF and DC voltages from RF source 195 and DC source 196, respectively, can be controlled to change the width of the range of interest, and specifically the low mass boundary and the high mass boundary of the range of interest: in other words, data for different mass transmission windows can be acquired at mass spectrometer 100, for example data outlining the effect of different RF and DC voltages on the low mass boundary and the high mass boundary of a range of interest.

Figure 3:
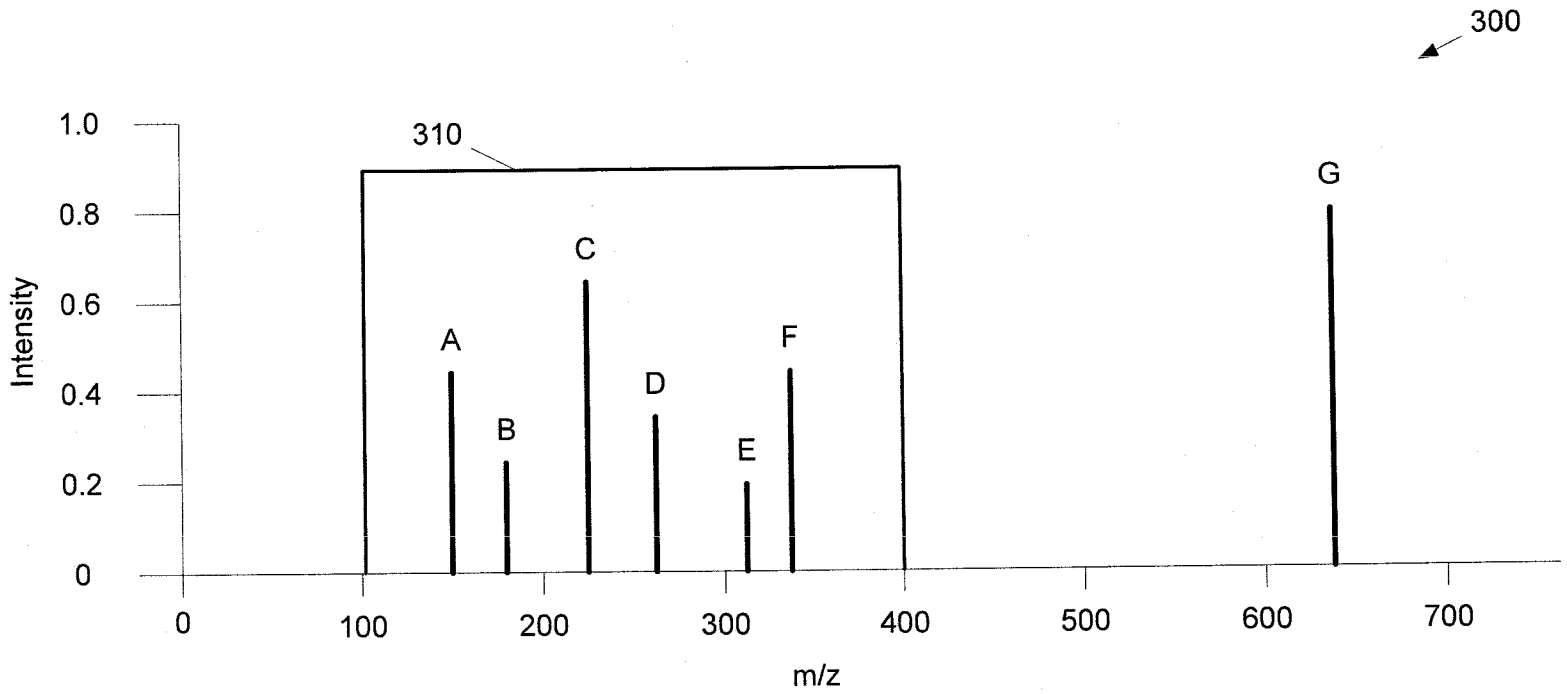
FIG. 3 depicts a schematic diagram of a representative mass spectrum collected from a ToF detector in the mass spectrometer of FIG. 1 when no filtering occurs in a quadrupole mass filter, according to non-limiting embodiments.
Figure 4:
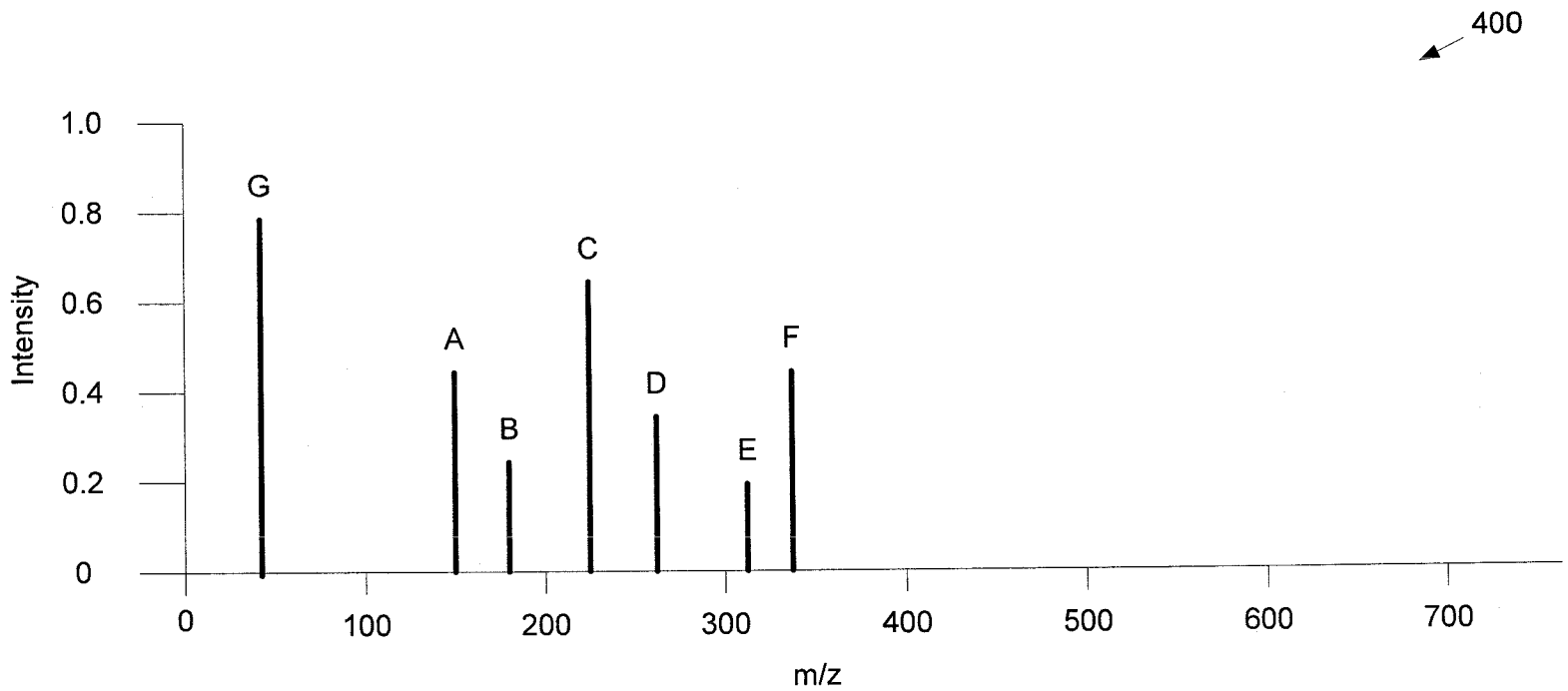
FIG. 4 depicts a schematic diagram of a representative mass spectrum collected from a ToF detector in the mass spectrometer of FIG. 1 when wrap-around occurs in the mass spectrum, according to non-limiting embodiments.

Attention is now directed to FIG. 3 which depicts a schematic diagram of a representative mass spectrum 300 collected from ToF detector 160 when no filtering occurs in quadrupole mass filter 140. In these embodiments, mass spectrum comprises mass species A, B, C, D, E, F and G, with mass species G having a relatively higher mass than mass species A, B, C, D, E, and F. As such, mass species G travel at a slower rate than A, B, C, D, E, and F through mass spectrometer 100, and specifically at a slower rate from mass quadrupole analyzer 140 and through ToF detector 160. Hence, depending on the extraction rate of mass spectrometer 100, mass species G can "wrap around" in the spectrum and erroneously appear as a low mass species in a next mass spectrum 400, as depicted in FIG. 4, according to non-limiting embodiments. Hence, if mass species G is outside of a range of interest, it is desirable to control the RF and DC voltages applied to mass quadrupole mass filter 140 in order to control at least the high mass boundary of the range of interest to exclude the mass species G from ions 191. Returning to FIG. 3, quadrupole mass filter 140 can be controlled to have mass range of interest 310, with a low mass boundary of 100 m/z and a high mass boundary of 400 m/z. Hence, mass species G is filtered from ions 191, while mass species A, B, C, D, E and F are included in ions 191, resulting in mass spectra 500 depicted in FIG. 5, according to non-limiting embodiments.

Such filtering further enables overpulsing of ToF detector 160, to increase the duty cycle of mass spectrometer 100. In general it is understood that the entry of ions 191 into ToF detector 160 is sampled in slices, in that a first portion of ions 191 are extracted from ions 191 and into ToF detector 160 such that a mass spectrum can be acquired, such as mass spectrum 300 or mass spectrum 400. The first portion of ions 191 injected into ToF detector 160 then travels through ToF detector 160 on a path 197, as depicted in FIG. 1, with lighter ions travelling faster than heavier ions, and impinging on a suitable detector surface 198, the time of flight it takes to travel path 197 being proportional to the square root of the mass to charge ratio of an ion. In general, mass spectrometer 100 is controlled such that a second portion of ions 191 is not extracted into ToF detector 160 until the first portion of ions 191 is collected at detection surface 198. However, shorter cycles i.e. higher extraction rates, which are generally preferred for better efficiency, lead to the wrap around effect depicted in FIG. 4 and hence erroneous mass spectra if the sample introduced into mass spectrometer 100 is generally unknown.

In any event, by controlling quadrupole mass filter 140 to filter out ions outside a range of interest, leaving ions 191 inside a range of interest, overpulsing ToF extraction to increase a duty cycle of mass spectrometer 100 can be utilized, in which a second portion of ions 191 are extracted into ToF detector 160 before the first portion of ions 191 arrive at the detection surface 198. Hence, duty cycle is increased, and the wrap around effect is eliminated.

In some embodiments, a width of the mass range of interest can be coordinated with the overpulsing, in that if wrap around is detected while mass spectrometer 100 is operated in an overpulsing mode, then the mass range of interest can be reduced until wrap around is eliminated. For example, if a second mass spectra comprises a low mass species that is not present in a first mass spectra, it can be determined that wrap around is occurring, and that the low mass species is in reality a high mass species within the range of interest that has not been given sufficient time to reach detector surface 198 before the second portion of ions 191 are introduced into ToF detector 160. The high mass boundary of the range of interest can then be lowered to eliminate the high mass species, resulting in the width of the mass range of interest being coordinated with the overpulsing.

In yet further embodiments, mass spectrometer 100 can be operated in an MSMS mode such that ions 191 are fragmented in collision cell 150, prior to analyzing ions from collision cell 150 at ToF detector 160. Hence, ions 191 are fragmented to produce fragmented ions which are analyzed at ToF detector 160. In some of these embodiments, ions 191 enter collision cell 150 with kinetic energy sufficient to cause said fragmentation within collision cell 150. In other embodiments, the pressure within collision cell 150 can be controlled to cause fragmentation, as described above.

In yet further embodiments, collision cell 150 can be operated in a bandpass mode, similar to quadrupole mass filter 140, by applying a combination of RF and DC voltages in collision cell 140 such that at least a portion of ions outside of a fragmented range of interest are filtered from ion beam, leaving ions inside the fragmented range of interest in the ion beam. For example, in embodiments, where collision cell 150 comprises a quadrupole, similar to quadrupole mass filter 140, fragmented ions can be filtered in a manner similar to that described above, by controlling RF and DC voltages applied to collision cell 150. It is understood that due to the presence of the buffer gas, sharpness of the filtering in collision cell 150 can be inferior to the filtering in quadrupole mass filter 140.

Attention is now directed to FIG. 6 which depicts a method 600 for filtering ions in a mass spectrometer. In order to assist in the explanation of the method 600, it will be assumed that the method 600 is performed using mass spectrometer 100. Furthermore, the following discussion of the method 600 will lead to a further understanding of mass spectrometer 100 and its various components. However, it is to be understood that mass spectrometer 100 and/or the method 600 can be varied, and need not work exactly as discussed herein in conjunction with each other, and that such variations are within the scope of present embodiments.

At step 610, mass spectrometer 100 is operated in MS mode, such that ions 190 and/or ions 191 in the ion beam remain substantially unfragmented. For example, a potential difference between the ion guide 130 and collision cell 150 can be controlled such that the ions entering collision cell 150 remain substantially unfragmented (e.g. ions enter collision cell 150 with a kinetic energy whereby ions remain substantially unfragmented). Alternatively, or in combination with controlling a potential difference between the ion guide 130 and collision cell 150, the pressure in collision cell 150 can be controlled such that ions entering collision cell 150 remain substantially unfragmented. It is generally understood that processor 185 can control suitable components of mass spectrometer 100 in order to operate mass spectrometer 100 in MS mode.

It is furthermore understood that the pressure in quadrupole mass filter 140 is lowered for efficient and reproducible control of the upper and lower boundaries of a mass region of interest. And furthermore understood that quadrupole mass filter 140 is operating at a pressure substantially lower than in either of ion guide 130 or collision cell 150.

At step 620, ions 190 produced at ion source 120 are injected into quadrupole mass filter 140. It is generally understood that processor 185 can control suitable components of mass spectrometer 100 in order to inject ions 190 into quadrupole mass filter 140.

At step 630, quadrupole mass filter 140 is operated in a bandpass mode such that ions outside of a range of interest are filtered from the ion beam, leaving ions 191 inside the range of interest in the ion beam. For example, a range of interest can be chosen by selecting suitable RF and DC voltages via operation of RF voltage source 195 and DC voltage source 196, respectively. Specifically, a low mass boundary and a high mass boundary of the range of interest can be defined by a combination of an RF voltage and a DC voltage applied to the quadrupole mass filter 140. Suitable RF and DC voltages can be determined based on a stability diagram for quadrupole mass filter 140, such as stability diagram 200, described above, such that ions outside of the range of interest are filtered from the ion beam. Furthermore, RF and DC voltages can be adjusted such that a slope of an operating line on the stability diagram for quadrupole mass filter 140 changes, thereby controlling the low mass boundary and the high mass boundary.

Alternatively, the RF and DC voltages can be determined by interpolating data for different transmission windows acquired at mass spectrometer 100 during a calibration/provisioning process previously performed via introduction of known samples into mass spectrometer 100, adjusting the RF and DC voltages, and measuring their effect on the bandpass range of the known samples.

In any event, it is generally understood that processor 185 can control suitable components of mass spectrometer 100 in order to operate quadrupole mass filter 140 in a bandpass mode such that ions outside of a range of interest are filtered from the ion beam.

At step 640, ions 191 are analyzed by ToF detector 160. In some embodiments, step 640 can comprise overpulsing ToF extraction to increase a duty cycle of mass spectrometer 100, as described above. In some of these embodiments, the overpulsing can be coordinated with a width of the range of interest. It is generally understood that processor 185 can control suitable components of mass spectrometer 100 to enabled analysis and/or overpulsing coordination.

In some embodiments, method 600 can further comprise fragmenting ions 191 at collision cell 150, prior to analyzing ions from collision cell 150 at ToF detector 160, for example by at least one of controlling the kinetic energy of ions 191 to a value sufficient enough to cause fragmentation in collision cell 150 and by controlling the pressure of collision cell 150 to a value sufficient to cause fragmentation of ions 191. In some of these embodiments, as described above, collision cell 150 can be operated in a bandpass mode, similar to quadrupole mass filter 140, by applying a combination of RF and DC voltages in collision cell 150 such that at least a portion of ions outside of a fragmented range of interest are filtered from the ion beam, leaving ions inside the fragmented range of interest in the ion beam. Hence, ions 190 can first be filtered at quadrupole mass filter 140 leaving ions 191. Ions 191 can then be fragmented at collision cell 150 and the fragmented ions can be filtered in a similar manner.

It is furthermore understood that in some embodiments, processor 185 can control mass spectrometer 100 to operate in a bandpass mode, wherein ions 190 are filtered at quadrupole mass filter 140 operating in bandpass mode as described above, and further control mass spectrometer to alternate between collecting mass spectra, via ToF detector 160, without fragmentation and with fragmentation. Individual mass spectra, with and without fragmentation, can be further processed with mathematical tools to extract information including, but not limited to, ion composition, presence of certain chemical groups, quantitative information about the presence of certain components, and the like.

In any event, by operating quadrupole mass filter 140 in a bandpass mode such that ions outside of a range of interest are filtered from the ion beam, leaving ions inside the range of interest in ion beam, the problem of wraparound is addressed. Furthermore, by eliminating ions outside of the range of interest from the ion beam, detection capacity of ToF detector 160 is addressed which also lengthens a lifetime of ToF detector 160.

Those skilled in the art will appreciate that in some embodiments, the functionality of mass spectrometer 100 can be implemented using pre-programmed hardware or firmware elements (e.g., application specific integrated circuits (ASICs), electrically erasable programmable read-only memories (EEPROMs), etc.), or other related components. In other embodiments, the functionality of mass spectrometer 100 can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium can be either a non-wireless medium (e.g., optical and/or digital and/or analog communications lines) or a wireless medium (e.g., microwave, infrared, free-space optical or other transmission schemes) or a combination thereof.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

What is claimed is:

1. A method for filtering ions in a mass spectrometer, said mass spectrometer comprising an ion guide, a quadrupole mass filter, a collision cell and a time of flight (ToF) detector, said mass spectrometer enabled to transmit an ion beam through to said ToF detector, the method comprising:

operating said mass spectrometer in MS mode, such that ions in said ion beam remain substantially unfragmented, said quadrupole mass filter operating at a pressure substantially lower than in either of said ion guide and said collision cell;

operating said quadrupole mass filter in a bandpass mode such that ions outside of a range of interest are filtered from said ion beam, leaving ions inside said range of interest in said ion beam, wherein a low mass boundary and a high mass boundary of said range of interest are defined by independently adjusting an RF voltage and a DC voltage applied to said quadrupole mass filter; and analyzing said ions inside said range of interest at said ToF detector and coordinating a width of said range of interest with overpulsing ToF extraction to increase a duty cycle of said mass spectrometer.

2. The method of claim 1, wherein said RF voltage and said DC voltage applied to said quadrupole mass filter are determined based on a stability diagram for said quadrupole mass filter.

3. The method of claim 2, wherein said operating said quadrupole mass filter in a bandpass mode such that ions outside of said range of interest are filtered from said ion beam comprises adjusting said RF voltage and said DC voltage such that a slope of an operating line on said stability diagram for said quadrupole mass filter changes, thereby controlling said low mass boundary and said high mass boundary.

4. The method of claim 2, wherein said stability diagram is derived from Mathieu's equation.

5. The method of claim 1, wherein said RF voltage and said DC voltage are determined by interpolating data for different transmission windows acquired at said mass spectrometer.

6. The method of claim 1, further comprising fragmenting said ions inside said range of interest in said ion beam, via said collision cell, prior to analyzing ions from said collision cell at said ToF detector.

7. The method of claim 6, wherein said fragmenting said ions inside said range of interest in said ion beam, via said collision cell occurs by at least one of controlling kinetic energy of said ions inside range of interest to a value sufficient to cause said fragmentation, and controlling pressure of said collision cell to a value sufficient to cause said fragmentation.

8. The method of claim 6, further comprising: alternating between fragmenting said ions inside said range of interest in said collision cell and allowing said ions in said range of interest to pass through said collision cell unfragmented; and collecting mass spectra of fragmented and unfragmented ions at said ToF detector for analysis.

9. The method of claim 6, further comprising operating said collision cell in a bandpass mode by applying a combination of RF and DC voltages in said collision cell such that at least a portion of said ions outside of a fragmented range of interest are filtered from said ion beam, leaving ions inside said fragmented range of interest in said ion beam.

10. The method of claim 1, wherein a pressure in said ion guide and said collision cell is in a mTorr range and said pressure in said quadrupole mass filter is in a $10^{-5}$ Torr range.

11. A mass spectrometer for filtering ions, comprising:

an ion guide, a quadrupole mass filter, a collision cell and a time of flight (ToF) detector, said mass spectrometer enabled to:

transmit an ion beam from said ion guide through to said ToF detector;

operate in MS mode, such that ions in said ion beam remain substantially unfragmented, said quadrupole mass filter operating at a pressure substantially lower than in either of said ion guide and said collision cell;

operate said quadrupole mass filter in a bandpass mode such that ions outside of a range of interest are filtered from said ion beam, leaving ions inside said range of interest in said ion beam, wherein a low mass boundary and a high mass boundary of said range of interest are defined by independently adjusting an RF voltage and a DC voltage applied to said quadrupole mass filter; and analyze said ions inside said range of interest at said ToF detector and coordinating a width of said range of interest with overpulsing ToF extraction to increase a duty cycle of said mass spectrometer.

12. The mass spectrometer of claim 11, wherein said RF voltage and said DC voltage applied to said quadrupole mass filter are determined based on a stability diagram for said quadrupole mass filter.

13. The mass spectrometer of claim 12, wherein to operate said quadrupole mass filter in a bandpass mode such that ions outside of said range of interest are filtered from said ion beam, said mass spectrometer is further enabled to adjust said RF voltage and said DC voltage such that a slope of an operating line on said stability diagram for said quadrupole mass filter changes, thereby controlling said low mass boundary and said high mass boundary.

14. The mass spectrometer of claim 11, wherein said RF voltage and said DC voltage are determined by interpolating data for different transmission windows acquired at said mass spectrometer.

15. The mass spectrometer of claim 11, further enabled to fragment said ions inside said range of interest in said ion beam, via said collision cell, prior to analyzing ions from said collision cell at said ToF detector.

16. The mass spectrometer of claim 15, wherein fragmentation of said ions inside said range of interest in said ion beam, via said collision cell occurs by at least one of controlling kinetic energy of said ions inside range of interest to a value sufficient to cause said fragmentation, and controlling pressure of said collision cell to a value sufficient to cause said fragmentation.

17. The mass spectrometer of claim 15, further enabled to: alternate between fragmenting said ions inside said range of interest in said collision cell and allowing said ions in said range of interest to pass through said collision cell unfragmented; and collecting mass spectra of fragmented and unfragmented ions at said ToF detector for analysis.

18. The mass spectrometer of claim 15, further enabled to operate said collision cell in a bandpass mode by applying a combination of RF and DC voltages in collision cell such that at least a portion of said ions outside of a fragmented range of interest are filtered from said ion beam, leaving ions inside said fragmented range of interest in said ion beam.

19. The mass spectrometer of claim 11, wherein a pressure in said ion guide and said collision cell is in a mTorr range and said pressure in said quadrupole mass filter is in a $10^{-5}$ Torr range.

* * * * *